United States Patent [19]

Elston

[11] 4,429,730

[45] Feb. 7, 1984

[54] CARGO CONTAINER COVER

[75] Inventor: Ronald W. Elston, Burnham, England

[73] Assignee: Transequip Limited, Feltham, England

[21] Appl. No.: 341,763

[22] Filed: Jan. 22, 1982

[30] Foreign Application Priority Data

Jan. 28, 1981 [GB] United Kingdom ..... 8102618

[51] Int. Cl.[3] ..... A47H 3/00

[52] U.S. Cl. ..... 160/368 R; 220/15

[58] Field of Search ..... 160/368 R; 220/1.5

[56] References Cited

U.S. PATENT DOCUMENTS 4,046,186 9/1977 Nordstrom ..... 160/368 R

*Primary Examiner*—Peter M. Caun

*Attorney, Agent, or Firm*—Diller, Ramik & Wight

[57] ABSTRACT

A cover for an opening in a cargo container comprises a flexible curtain secured at the top of the opening to the container. The curtain has at its sides and lower portion peripheral tunnels accommodating at least one peripheral strand, and at its back inclined tunnels accommodating at least two bracing strands, and has at its lower portion spaced apart fittings, including each guiding and attachment means for the strands, and a first part of a two-part over-center clip. Said first part is engageable with the second part of the clip, the second part being attached to the container within or adjacent the opening.

4 Claims, 5 Drawing Figures

CARGO CONTAINER COVER

The invention relates to a cover for an opening in a cargo container, particularly a container to be borne by aircraft.

A cover in the form of a flexible curtain for covering a substantially rectangular opening in a cargo container is known from U.S. Pat. No. 4,046,186. The curtain includes a peripheral cable and two diagonal cables. The curtain is at its upper end attached to the container and the diagonal cables are permanently secured at the upper corners of the opening and temporarily secured at the lower corners by fittings which may be manually slipped over posts and serve to fix the bottem end of the curtain to close the opening. The curtain is then firmly sealed in position by tensioning the peripheral cable by a ratchet assembly.

The known cover has the disadvantage that the diagonal cables cannot be tensioned, and the ratchet mechanism is too complicated and costly.

The aim of the invention is to avoid or at least to mitigate these disadvantages.

The invention provides a cover for an opening in a cargo container, the cover comprising a flexible curtain secured at the top of the opening to the container, characterised in that the curtain has at its sides and lower portion peripheral tunnels accommodating at least one peripheral strand, and at its back inclined tunnels accommodating at least two bracing strands, the curtain including at its lower portion spaced apart fittings including each guiding means and/or attachment means for the strands, and a first part of a two-part over-centre clip, said first part being engageable with the second part of the clip, the second part being attached to the container within or adjacent the opening.

In one preferred embodiment the curtain is substantially rectangular and has one said first part of said clip in each bottom corner, each said first part cooperating with a respective one second part in the bottom corner of said opening.

The cover preferably comprises at least two pivotally mounted bellcranks to one arm of each bellcrank being attached one end of one said peripheral strand and to the other arm being connected one end of one said bracing strand.

Advantageously at least one end of at least one of said cables is attached to tension adjustment means.

Figure 1:
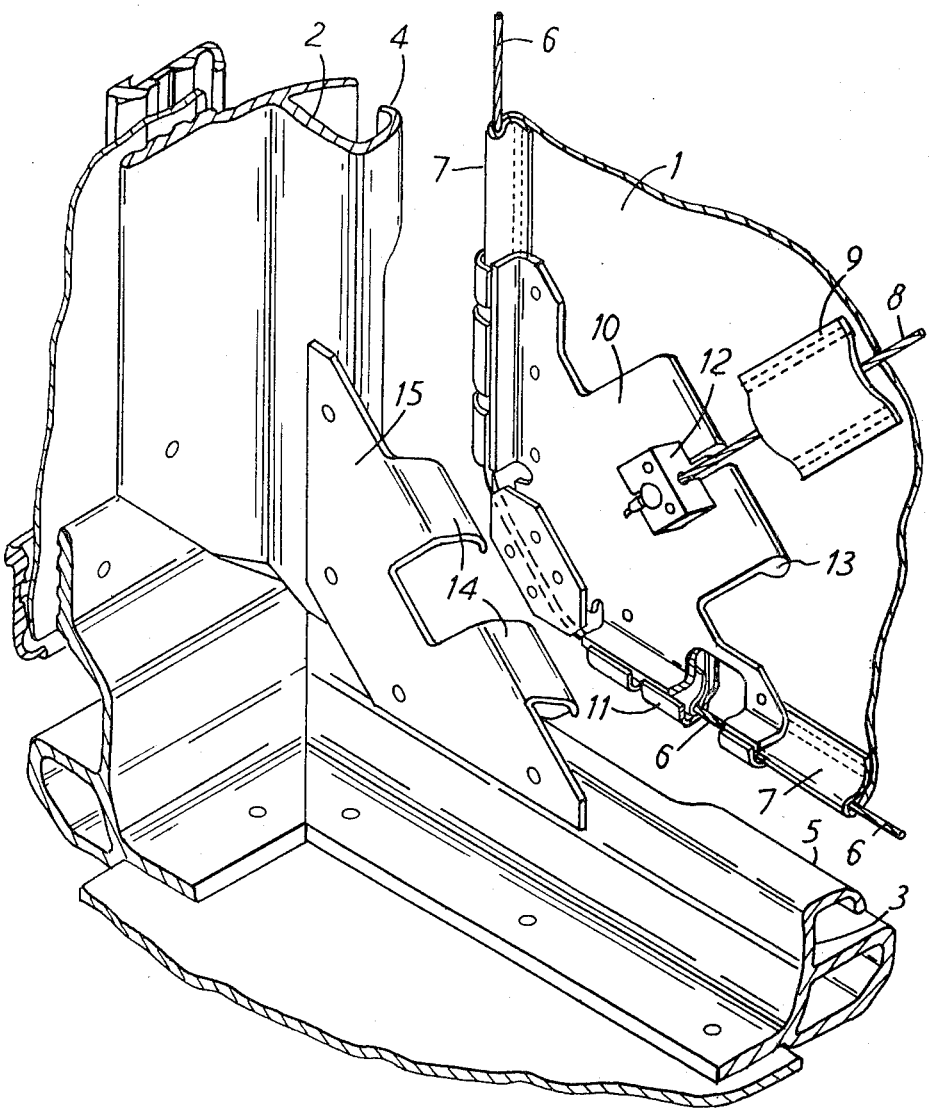
Figure 2:
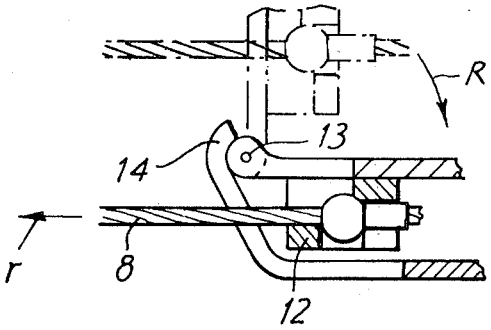
Figure 3:
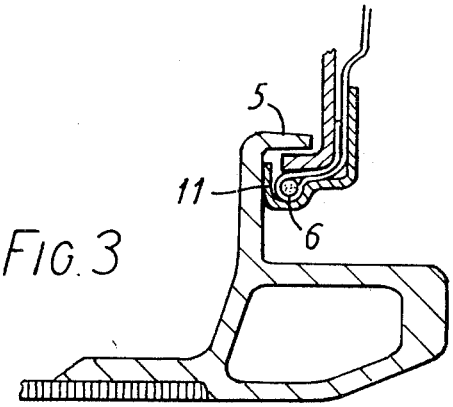
Figure 4:
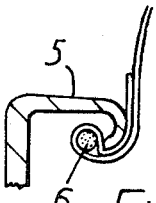
Figure 5:
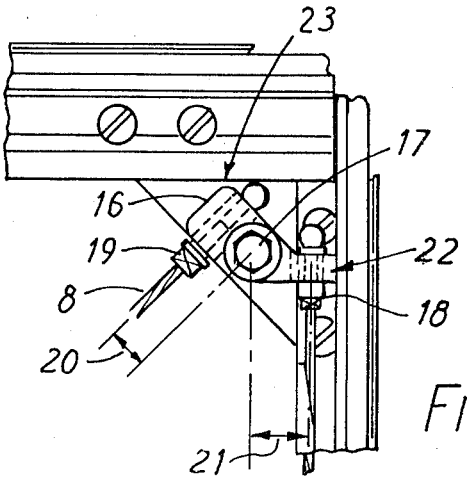

The invention will now be described, by way of example, with reference to the accompanying diagrammatic drawings, in which:

FIG. 1 shows in perspective a corner part of a container and a corner part of a cover therefor, FIG. 2 shows a two-part over-centre clip and the manner of its functioning, FIGS. 3 and 4 show details of location of a peripheral cable in a channel, and FIG. 5 shows details of a bell-crank used to obtain correct cable tension.

A corner part of a cargo container having a substantially rectangular opening therein, and a corner part of a cover for that opening are shown in FIG. 1. The top part of the opening is delimited by a header (not shown), its sides by side rails 2 (only one shown) and its bottom by a bottom rail 3. The header and rails 2,3 are secured to the container and form a frame defining the opening. The rails 2,3 have slightly curved flanges 4,5 which delimit a peripheral channel. Also shown is a flexible curtain 1 which is also substantially rectangular but larger than the opening, and is made e.g. of a suitable fabric made weatherproof by a coating of a suitable plastics.

The curtain 1 is secured across the top of the opening by said header and is at its sides and bottom provided with one or more peripheral tunnels 7 which accommodate a peripheral cable 6.

In the illustrated embodiment the peripheral tunnel 7 is formed by sewing as a casing at the periphery of the curtain 1 which overhangs the flanges 4,5. At the back of the curtain 1 are attached diagonal tunnels 9 (only one shown—here formed by sewing) accommodating diagonal cables 8 (only one shown). Both the peripheral cable 6 and the diagonal cables 8 may be sheathed.

The curtain 1 is at each of its bottom corners provided with a fitting 10 which is firmly secured to the curtain 1 and includes a guide 11 for the peripheral cable 6, a cable attachment 12 for one of the diagonal cables 8, and a male part 13 of a two-part over-centre clip. The male part 13 of the clip is set across the lower corner of the curtain and is adapted to co-operate with a female part 14 formed on a gusset member 15 set across the adjacent lower corner of said opening and firmly secured to the frame formed by the rails 2 and 3. The male and female parts 13,14 of the clip extend approximately at right angles to the associated diagonal cable 8.

For closing the container, the lower corners of the curtain 1 are bent, the male parts 13 are engaged with the associated female parts 14, and the corners are levered, as shown by the arrow R in FIG. 2, to cause the two-part over-centre clips to clamp together. During that movement the peripheral tunnel 7 with the peripheral cable 6 therein enters the channel delimited by the flanges 4,5 and both the peripheral cable 6 and the diagonal cables 8 are taut, whereby the peripheral cable 6 is tensioned and firmly holds the curtain in a position in which it seals the opening, and the diagonal cables 8 are pulled tight so that they brace, and thus reinforce, both the curtain 1 and the container. In this position the curtain 1 can be secured in a manner known per se, against unwanted or unauthorized opening.

While only one peripheral cable is shown which passes from the top on one side of the curtain 1 to the top on the other side, more cables may be used, e.g. one for each side and one for the bottom, or two cables, each extending from the top of one side to the middle of the bottom. Instead of two diagonal cables, which act as bracing cables crossing each other, more than two bracing cables may be used, particularly if the opening, and consequently the curtain, are not substantially rectangular as in the illustrated embodiment.

Refinements may be added to improve the ease of operation and/or the distribution of loads in the aforementioned strands, e.g. instead of attaching the top ends of the strands directly to the container structure they may be provided with:

(a) attachmemnts incorporating length adjustment means for the strands to achieve particular tensions in the strands when the door is closed and/or (b) a bellcrank arrangement to allow for easier closing and control of the ratios of tensions in adjacent strands.

These refinements will now be described with reference to FIG. 5 on the example of a rectangular flexible curtain 1 for covering a rectangular opening defined by a frame. The corners of the curtain and frame and also the devices situated in these corners will be distinguished for simplicity of explanation by the following letters: LU=left-hand upper, LB=left-hand bottom, RU=right-hand upper, and RB=right-hand bottom. It will be further presumed that the curtain 1 has two peripheral cables 6,6' and two diagonal cables 8,8' extending as follows: cable 6 between LU and LB corners, cable 6' between RU and RB corners, cable 8 between LB and RU corners and cable 8' between LU and RB corners. While FIG. 1 shows the LB corner (looking from inside the container), FIG. 5 shows the LU corner looking from the outside, but for simplicity of explanation FIG. 5 will be deemed to show the RU corner looking from the inside.

An RU bellcrank 16 is attached, via a pivot 17, to the container frame in the RU corner thereof. The bellcrank 16 has a first arm provided with an opening accommodating an adjustment screw 18 to which is attached the peripheral cable 6', and a second arm provided with an opening accommodating an adjustment screw 19 to which attached the diagonal cable 8. The distance between the axis of the opening in the second arm (which is also the axis of the cable 8) and the axis of the pivot 17 will be referred to as offset 20, and the distance between the axis of the opening in the first arm (which is also the axis of the cable 6')and the axis of the pivot 17 will be referred to as offset 21. The cables 6' and 8 are so connected by their respective adjustment screws 18 and 19 to the bellcrank 16 that when the curtain 1 is closed and correctly adjusted the ratio of tensions in the cables 6' and 8 is equal to the ratio of the lever offset 20 and 21, ignoring friction. The operation of the curtain 1 to close the lower corners now requires less effort.

On closing the LB corner the tension on its diagonal cable 8 acting through the RU bellcrank causes that bellcrank to rotate because the peripheral cable 6' on that bellcrank is connected to the RB corner which is not closed and therefore provides no reacting tension. Similarly, tension exerted on the peripheral cable 6 in the LB corner causes the LU bellcrank to rotate because the diagonal cable 8' on that bellcrank is connected to the RB corner which is not closed.

On closing the RB corner the tension on its diagonal cable 8' acting through the LU bellcrank causes that bellcrank to rotate, generating a tension in the peripheral cable 6 attached to that bellcrank until that bellcrank is "balanced" with the correct ratio of tensions in the cables 6 and 8', and similarly with the peripheral cable 6' from the RB corner to the RU bellcrank balancing the other diagonal cable 8.

Thus the same final tensions are achieved as if the cables had been rigidly attached to the structure at their upper ends, but the closing of the second corner, in the above example the RB corner, requires less effort since each cable has a longer "effective" length through the associated bellcrank so that its effective "stiffness" is reduced.

In order that the diagonal and peripheral cables may still provide their original stiffness to brace the container and provide cargo constraint, each bellcrank is designed so that its angles of rotation either way from its mid-position are kept small by the bellcrank arms contacting the container structure at points 22, 23 (FIG. 5) or by providing fixed or adjustable stops. When the bellcrank is thus prevented from rotation, the cables then act as if they were attached directly to the container structure.

It will be appreciated that instead of a cable some other "strand" may be used, e.g. a wire or rope. The strands may be combined with resilient or non-resilient tensioning means.

I claim:

1. A cover for an opening in a cargo container, the cover comprising a flexible curtain secured at the top of the opening to the container, wherein the curtain has at its sides and lower portion peripheral tunnels accommodating at least one peripheral strand, and at its back inclined tunnels accommodating at least two bracing strands, the curtain including at its lower portion spaced apart fittings including each guiding and attachment means for the strands, over-centre clip means for simultaneously pulling taut said one peripheral strand and said at least two bracing strands during relative pivoting movement of first and second parts of said over-centre clip means, said over-centre clip means being an over-centre clip having first and second parts, said second part being attached to the container adjacent the opening, and said first part being connected to said one peripheral strand and said at least two bracing strands whereby upon movement of said first part from a nonover-centre position relative to said second part to an over-centre position of said first part relative to said second part, said peripheral and bracing strands are drawn taut.

2. A cover according to claim 1 wherein the curtain is substantially rectangular and has one said first part of said clip in each bottom corner, each said first part cooperating with a respective one second part in the bottom corner of said opening.

3. A cover according to claim 1 or 2 comprising at least two pivotally mounted bellcranks to one arm of each bellcrank being attached one end of one said peripheral strand and to the other arm being connected one end of one said bracing strand.

4. A cover according to claim 1, 2 or 3 wherein at least one end of at least one of said cables is attached to tension adjustment means.

* * * * *